United States Patent [19]

Williamson et al.

[11] Patent Number: 4,475,433

[45] Date of Patent: Oct. 9, 1984

[54] CAPO FOR A STRINGED MUSICAL INSTRUMENT

[75] Inventors: John Williamson; Robert Falloon, both of Warnham, England

[73] Assignee: Muse Music Company, Limited, England

[21] Appl. No.: 390,957

[22] Filed: Jun. 22, 1982

Related U.S. Application Data

[63] Continuation-in-part of Ser. No. 212,814, Dec. 4, 1980, abandoned.

[30] Foreign Application Priority Data

Jun. 6, 1980 [GB] United Kingdom ..... 8018629

[51] Int. Cl.[3] ..... G10D 3/04; G10G 7/02

[52] U.S. Cl. ..... 84/318; 84/456

[58] Field of Search ..... 84/318, 456

[56] References Cited

U.S. PATENT DOCUMENTS

| | | | |
|---|---|---|---|
| 583,102 | 5/1897 | Utt | 84/318 |
| 753,327 | 3/1904 | Sprotte | 84/456 |
| 3,722,346 | 3/1973 | Valentino | 84/318 |
| 3,823,247 | 7/1974 | Bauerfeind | 84/318 |
| 4,019,504 | 4/1977 | Sterling | 128/88 |
| 4,104,947 | 8/1978 | Oster | 84/318 |
| 4,143,576 | 3/1979 | Nichols et al. | 84/318 |
| 4,183,279 | 1/1980 | Shabram | 84/318 |

*Primary Examiner*—Lawrence R. Franklin

*Attorney, Agent, or Firm*—Charles W. Helzer; Charles W. Helzer

[57] ABSTRACT

A capo for a stringed musical instrument, comprising a substantially rigid bar member for engaging the strings of a musical instrument, a flexible strap which can be passed around the neck of the musical instrument to maintain the bar member in engagement with said strings, and securing means whereby the strap can be secured. Preferably the strap is secured at one end to one end of the bar member and the other end of the bar member has a transverse slot therein through which the other end of the strap can be passed and doubled back on itself and secured by means of a releasable touch-and-close fastener the two components of which are provided at different positions on one surface of the strap. In an embodiment at least one tuning reed is provided in a bore in the bar member to enable the capo to serve the further function of a pitch-pipe for tuning.

13 Claims, 7 Drawing Figures

CAPO FOR A STRINGED MUSICAL INSTRUMENT

This application is a continuation-in-part of application Ser. No. 212,814 filed Dec. 04, 1980, now abandoned.

This invention relates to capos for stringed musical instruments.

It is known to use with stringed musical instruments such as guitars, banjos and the like a device known as a capo for effecting changes in the tuning of the instrument. In use the capo is mounted around the neck of the stringed instrument and serves to apply pressure on all of the strings of the instrument to effect a similar change in the tuning of all of the strings, the capo being adjusted as required along the neck of the instrument to obtain the desired tuning. Known capos are generally made of metal and are substantially D-shaped comprising a semi-circular portion and a bar which is hinged at one end to one free end of the semi-circular portion and the other end of which is releasably securable to the other free end of the semi-circular portion by a suitable toggle lever arrangement or screw arrangement, the semi-circular portion being adapted to extend around the rear and sides of the neck of a stringed instrument and the bar to extend across and apply pressure on the strings.

Known capos of the kind aforesaid suffer from the disadvantages that they are somewhat heavy and cumbersome in use; can be difficult to mount on a stringed instrument particularly in a hurry, and, more importantly, that because the clamping pressure on the strings tends to be somewhat haphazard according to the clamp adjustment so that the clamping pressure is not always evenly distributed over the strings and small differences in the tuning of the different strings can occur.

The present invention has as its object to provide a capo for a stringed musical instrument which overcomes the aforesaid disadvantages.

A further object of the invention, according to a preferred embodiment thereof, is to provide a capo which will serve the further function of a pitch-pipe for tuning.

The present invention provides a capo for a stringed musical instrument, the capo comprising a bar member for engaging the strings of a said musical instrument, said bar having a depending flange at one end thereof adapted to engage a side surface of the neck of a said musical instrument to locate the bar member relative to the instrument and a transverse slot adjacent the other end thereof, a strap one end of which is connected to said one end of the bar and the other end of which, after having been passed around the neck of a said instrument, is adapted to be passed through said transverse slot and pulled tight to draw said depending flange firmly into engagement with said side surface of the neck of the instrument and to exert a pull on both ends of said bar member and draw said bar member firmly and evenly into engagement with the strings of the instrument, and releasable fastening means having two components which are provided at different locations along an outer surface of said strap whereby after said other end of the strap has been passed through said slot it can be doubled back on itself and secured by engagement of the two components of the fastening means one with the other, said bar member being substantially rigid but having sufficient resilience therein as to deflect to the shape of that part of the instrument over which the strings pass when a said pull is exerted on the ends of the bar member.

The said bar member is preferably formed, e.g., moulded, from a suitable plastics material such as a suitable acetal resin of the kind sold under the Registered Trade Mark "Delrin", although it could be formed from wood, metal or other suitable material.

The important thing is that the material and thickness of the bar member are such that the bar member is "substantially rigid," by which term is meant that the bar member is to all intents and purposes rigid but retains sufficient resilience to deflect to the shape of that part of the instrument over which the strings pass when a pull is exerted on the ends of the bar member by the tightening of said strap.

Preferably the bar member has a depending flange at one end thereof adapted to engage a side surface of the neck of a said stringed instrument and which serves to locate the bar member relative to the instrument. Preferably also that surface of the bar member which engages the strings of an instrument is faced with a suitable elastomeric material, e.g., a strip of natural or synthetic rubber having a shore hardness of from 30 to 40.

Said releasable fastening means may be any suitable two-part fastener such as one or more press or snap fasteners. According to a preferred embodiment, however, the releasable fastening means comprises a releasable touch-and-close fastener of the kind sold under the Registered Trade Mark "Velcro".

A further feature of the present invention, according to a preferred embodiment thereof, is that the capo incorporates a tuning means so that it can serve the dual functions of both a capo and a tuner or pitch-pipe. In this embodiment the said bar member has at least one aperture therein and the tuning means is mounted in said aperture. Preferably said tuning means comprises a reed adapted, when blown, to produce a note of a particular pitch, whereby the capo can also be used as a pitch-pipe. If desired said bar member can have a plurality of apertures therein each of which has a said reed mounted therein, the reeds being adapted to produce notes of different predetermined pitches to facilitate the tuning of a stringed musical instrument. Where only a single aperture and reed are provided then these are preferably in an end wall of the bar member whereas when a plurality of apertures and reeds are provided then these are preferably spaced along a side wall of the bar member and extend tranversely of the bar member.

The invention will be more particularly described with reference to the accompanying drawings, in which.

Figure 1:
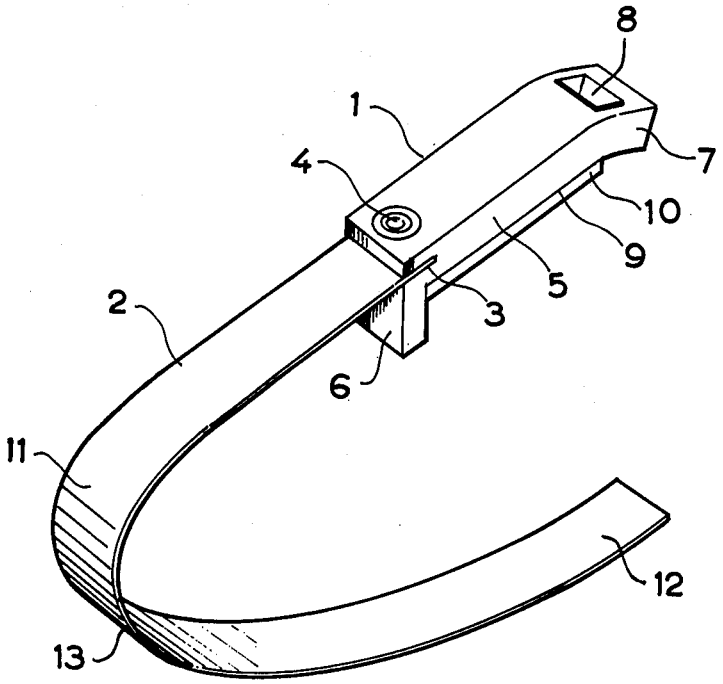
FIG. 1 is a perspective view of one embodiment of a capo according to the present invention.

Referring to FIG. 1 of the drawings it will be seen that the capo comprises a substantially rigid bar member 1 moulded from a suitable plastics material, e.g., a suitable acetal resin, and a flexible strap 2, one end of the strap 2 being secured to one end of the bar member 1 by inserting said one end of the strap 2 into a slot 3 provided in said one end of the bar member 1 and securing it as by means of a rivet 4.

The bar member 1 comprises a straight rectangular cross-section central portion 5, a depending flange 6 at said one end and an end portion 7 at the other end which is inclined downwardly at an obtuse angle to the central portion 5. A slot 8 is provided in the end portion 7 through which the other end of the strap 2 can be threaded. The lower surface 9 of the central portion 5 is faced with strip 10 of elastomeric material, preferably a strip of natural or synthetic rubber having a shore hardness of from 30 to 40. The exposed lower surface of the strip 10 which engages the strings of an instrument when the capo is in use may be provided with a series of longitudinally extending ribs (not shown).

In the illustrated embodiment the strap 2 comprises a strip of a flexible releasable touch-and-close fastener of the kind sold under the Registered Trade Mark "Velcro", the surface 11 of the end portion 12 of the strap remote from the bar member 1 comprising one component of the touch-and-close fastener and the surface 11 of at least the intermediate portion 13 of the strap 2 comprising the other component of the touch-and-close fastener. With this arrangement the end portion 12 of the strap 2 can be threaded through the slot 8 and the strap 2 then doubled back on itself and secured by pressing the surface 11 of the end portion 12 against the surface 11 of the intermediate portion 13.

In use, the bar member 1 is placed across the strings of a stringed musical instrument with the elastomeric strip 10 in engagement with the strings and the flange 6 abutting the adjacent side surface of the neck of the instrument. The strap 2 is then passed around the neck of the instrument, the end portion 12 of the strap 2 threaded through the slot 8 and the strap 2 then doubled back on itself and pulled tight before pressing the surface 11 of the end portion 12 thereof against the surface 11 of the intermediate portion 13 to secure the releasable touch-and-close fastening.

The pulling tight of the strap 2 draws the flange 6 tightly against the adjacent side surface of the neck of the instrument and exerts a pull on the ends of the bar member 1 which causes the bar member 1 to deflect just sufficiently to conform to any slight curvature of that surface of the neck of the instrument over which the strings pass.

It will readily be appreciated that the capo illustrated is light in weight, is quickly and easily mounted on or removed from the neck of a stringed musical instrument and automatically adjusts to accommodate different sizes and shapes of different stringed musical instruments. Morever, because of the slight deflection of the bar member 1 and the provision of the elastomeric strip 10 the pressure exerted by the bar member 1 is substantially evenly distributed over the different strings of an instrument to eliminate differences occurring in the tuning of the different strings due to the capo.

Figure 2:
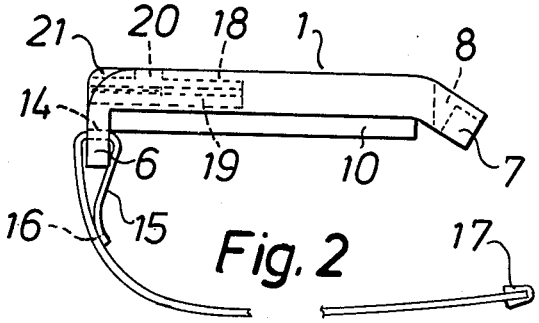
FIG. 2 is a side elevation of another embodiment of a capo according to the present invention.
Figure 4:
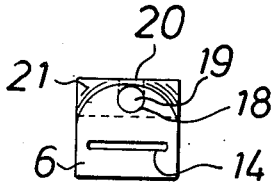
FIG. 4 is an end view of the capo shown in FIG. 2.
Figure 3:
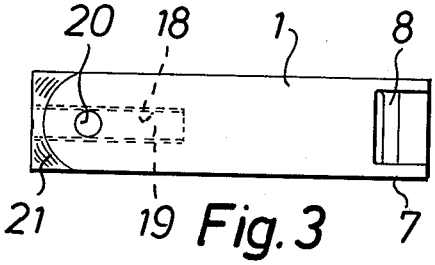
FIG. 3 is a plan view of the capo shown in FIG. 2.

The capo illustrated in FIGS. 2, 3 and 4 is substantially the same as that illustrated in FIG. 1 and like reference numerals have been used to refer to like parts. In the embodiment of FIGS. 2, 3 and 4 the said one end of the strap 2 (which has been omitted from FIGS. 3 and 4) is secured to said one end of the bar member 1 by passing the one end of the strap 2 through a transverse slot 14 provided in the depending flange 6, doubling said one end of the strap 2 back on itself as shown at 15 and securing it as by means of a row of stitching 16.

The other end of the strap 2 is tipped with a metal or plastics cap 17 to prevent fraying thereof and to facilitate its insertion through the slot 8 in the other end of the bar member 1. Extending into the bar member 1 from the flanged end thereof is a cylindrical aperture or bore 18 in which is mounted a tuning reed 19 adapted, when blown, to produce a note of a particular pitch for use in tuning a stringed musical instrument. In the illustrated embodiment the tuning reed 19 produces the note E and thus enables the E-string of say a guitar to be tuned to the correct pitch, whereafter the remaining strings can be tuned from the E-string. A circular aperture 20 in the upper surface of the bar member 1 communicates with the bore 18 and provides an outlet for air blown into the bore 18. The upper corners of the bar member 1 at the flanged end thereof are chamferred or rounded as shown at 21 so that there are no sharp edges to come into contact with the mouth of a user when the capo is being used as a pitch-pipe for tuning.

Figure 5:
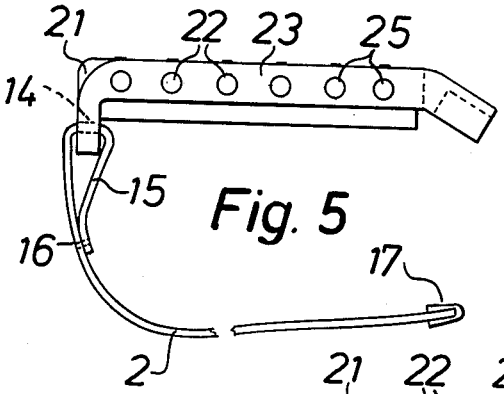
FIG. 5 is a side elevation of yet another embodiment of a capo according to the present invention.
Figure 7:
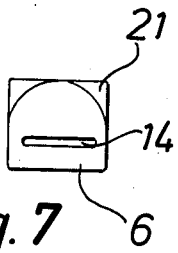
FIG. 7 is an end view of the capo shown in FIG. 5.
Figure 6:
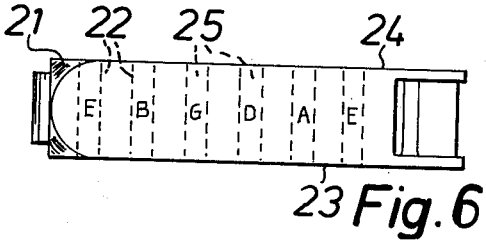
FIG. 6 is a plan view of the capo shown in FIG. 5.

The capo illustrated in FIGS. 5, 6 and 7 is essentially the same as that illustrated in FIGS. 2, 3 and 4 and again like reference numerals have been used to indicate like parts. The only difference in the embodiment of FIGS. 5, 6 and 7 is that in place of the bore 18 and reed 19 the bar member 1 has a series of spaced bores 22 extending transversley therethrough from one side wall 23 to the opposite side wall 24 and a series of reeds 25 are provided in these bores, the reeds 25 each being adapted to produce a note of a different pitch to facilitate the tuning of the different strings of a stringed musical instrument. In the illustrated embodiment the bar member 1 has six bores 22 therein each of which accommodates a reed 25 and the reeds are adapted to produce the notes E, B, G, D, A, E as indicated on the upper surface of the bar member 1 in FIG. 6, these being the notes to which the six strings of guitar are usually tuned. However, it will be understood that a different number of reeds and/or reeds which produce different notes can be provided if desired to accord with the strings of other stringed musical instruments.

We claim:

1. A capo for a stringed musical instrument, the capo comprising a resilient bar member having a flat surface for engaging the strings of a said musical instrument, said bar member having a depending flange at one end thereof adapted to hook over and engage a side surface of the neck of a said musical instrument to locate the bar member relative to the instrument and a transverse slot adjacent the other end thereof, a strap one end of which is connected to said one end of the bar member and the other end of which, after having been passed around the neck of a said instrument, is adapted to be passed through said transverse slot and pulled tight against the resistance of said depending flange engaging with said side surface of the neck of the instrument to exert a pull on both ends of said bar member and draw said bar member firmly and evenly into engagement with the strings of the instrument, and releasable fastening means having two components which are provided at different locations along an outer surface of said strap whereby after said other end of the strap has been passed through said slot it can be doubled back on itself and secured by engagement of the two components of the fastening means one with the other while maintaining the pull on both ends of the bar member, said bar member being substantially rigid but having sufficient resilience therein as to deflect to the shape of that part of the instrument over which the strings pass when a said pull is exerted on the ends of the bar member.

2. A capo according to claim 1, wherein the flat surface of the bar member which engages the strings of a musical instrument is faced with elastomeric material.

3. A capo according to claim 2, wherein said elastomeric material is a strip of natural or synthetic rubber having a shore hardness of from 30 to 40.

4. A capo according to claim 1, wherein said releasable fastening means comprises a releasable touch-and-close fastener the two components of which are provided at different positions along one side surface of the strap so that when said other end of the strap is passed through said slot and the strap is doubled back on itself the two components of the fastener can be pressed one against the other.

5. A capo according to claim 1, wherein said transverse slot is provided in an end portion of the bar member which is angled downwardly with respect to the remainder of the bar member.

6. A capo according to claim 1, wherein said bar member is moulded from synthetic plastics material.

7. A capo according to claim 1, wherein said bar member has at least one aperture therein and wherein tuning means is mounted in said aperture.

8. A capo according to claim 7, wherein said tuning means comprises a reed adapted, when blown, to produce a note of a particular pitch, whereby the capo can also be used as a pitch-pipe.

9. A capo according to claim 8, wherein said bar member has a plurality of apertures therein each of which has a said reed mounted therein, the reeds being adapted to produce notes of different predetermined pitches to facilitate the tuning of a stringed musical instrument.

10. A capo for a stringed musical instrument, the capo comprising a resilient bar member having a surface for engaging the strings of a said musical instrument and strap means which can be passed around the neck of said musical instrument and secured to maintain said bar member in engagement with the strings of the instrument, said bar member having at least one aperture therein and having tuning means mounted in said aperture, said tuning means comprising a reed adapted, when blown, to produce a note of a particular pitch, whereby the capo can also be used as a pitch-pipe for tuning the musical instrument.

11. A capo according to claim 10, wherein said bar member has a single said aperture in an end wall thereof, said reed being mounted in said aperture.

12. A capo according to claim 10, wherein said bar member has a plurality of apertures therein each of which has a said reed mounted therein, the reeds being adapted to produce notes of different predetermined pitches to facilitate the tuning of a stringed musical instrument.

13. A capo according to claim 12, wherein said plurality of apertures are spaced along a side wall of the bar member.

* * * * *